US008251790B2

(12) United States Patent
Moshal

(10) Patent No.: US 8,251,790 B2
(45) Date of Patent: Aug. 28, 2012

(54) BACKUP RANDOM NUMBER GENERATOR GAMING SYSTEM

(75) Inventor: John Hillel Moshal, La Lucia (ZA)

(73) Assignee: Cork Group Trading Ltd., Road Town (VG)

( * ) Notice: Subject to any disclaimer, the term of this patent is extended or adjusted under 35 U.S.C. 154(b) by 1077 days.

(21) Appl. No.: 10/576,743

(22) PCT Filed: Oct. 20, 2004

(86) PCT No.: PCT/IB2004/003424
§ 371 (c)(1),
(2), (4) Date: Jan. 9, 2007

(87) PCT Pub. No.: WO2005/045551
PCT Pub. Date: May 19, 2005

(65) Prior Publication Data

US 2007/0225057 A1 Sep. 27, 2007

(30) Foreign Application Priority Data

Oct. 22, 2003 (GB) ..... 0324627.9

(51) Int. Cl.
*A63F 9/00* (2006.01)

(52) U.S. Cl. ..... 463/16

(58) Field of Classification Search ..... 463/16
See application file for complete search history.

(56) References Cited

U.S. PATENT DOCUMENTS

| | | | | |
|---|---|---|---|---|
| 4,527,798 | A | 7/1985 | Siekierski et al. | |
| 5,326,104 | A * | 7/1994 | Pease et al. | 463/18 |
| 5,588,913 | A * | 12/1996 | Hecht | 463/19 |
| 5,623,625 | A * | 4/1997 | Thompson et al. | 711/113 |
| 5,674,128 | A * | 10/1997 | Holch et al. | 463/42 |
| 5,800,269 | A * | 9/1998 | Holch et al. | 463/42 |
| 5,989,121 | A | 11/1999 | Sakamoto | |
| 6,089,982 | A * | 7/2000 | Holch et al. | 463/42 |
| 6,108,300 | A * | 8/2000 | Coile et al. | 370/217 |
| 6,343,313 | B1 * | 1/2002 | Salesky et al. | 709/204 |
| 6,460,055 | B1 * | 10/2002 | Midgley et al. | 707/204 |
| 6,477,251 | B1 | 11/2002 | Szrek et al. | |
| 6,533,664 | B1 | 3/2003 | Crumby | |
| 6,594,786 | B1 * | 7/2003 | Connelly et al. | 714/50 |
| 6,811,482 | B2 * | 11/2004 | Letovsky | 463/7 |

(Continued)

FOREIGN PATENT DOCUMENTS

WO 00/79391 A1 12/2000

OTHER PUBLICATIONS

International Preliminary Report on Patentability issued in related international application No. PCT/IB2004/003424, dated Apr. 24, 2006, 5 sheets. Supplementary European Search Report, dated Feb. 21, 2008, from related application No. EP04791718.

*Primary Examiner* — Melba Bumgarner
*Assistant Examiner* — Seng H Lim
(74) *Attorney, Agent, or Firm* — McDonnell Boehnen Hulbert & Berghoff LLP

(57) ABSTRACT

A gaming system (1) comprises one or more player stations, a primary random event generator (2*g*) communicable with each player station by means of a communication network, a secondary random event generator (3*g*) communicable with each player station by means of the same communication network and a controller.

15 Claims, 1 Drawing Sheet

U.S. PATENT DOCUMENTS 6,811,484 B2 * 11/2004 Katz et al. ..... 463/17
2002/0082748 A1 * 6/2002 Enga et al. ..... 700/291
2003/0005350 A1 * 1/2003 Koning et al. ..... 714/4
2003/0120685 A1 * 6/2003 Duncombe et al. ..... 707/200
2004/0005918 A1 * 1/2004 Walker et al. ..... 463/16
2004/0006624 A1 * 1/2004 Hawkinson et al. ..... 709/227
2004/0204229 A1 * 10/2004 Walker et al. ..... 463/20
2004/0209683 A1 * 10/2004 Okada ..... 463/31

* cited by examiner

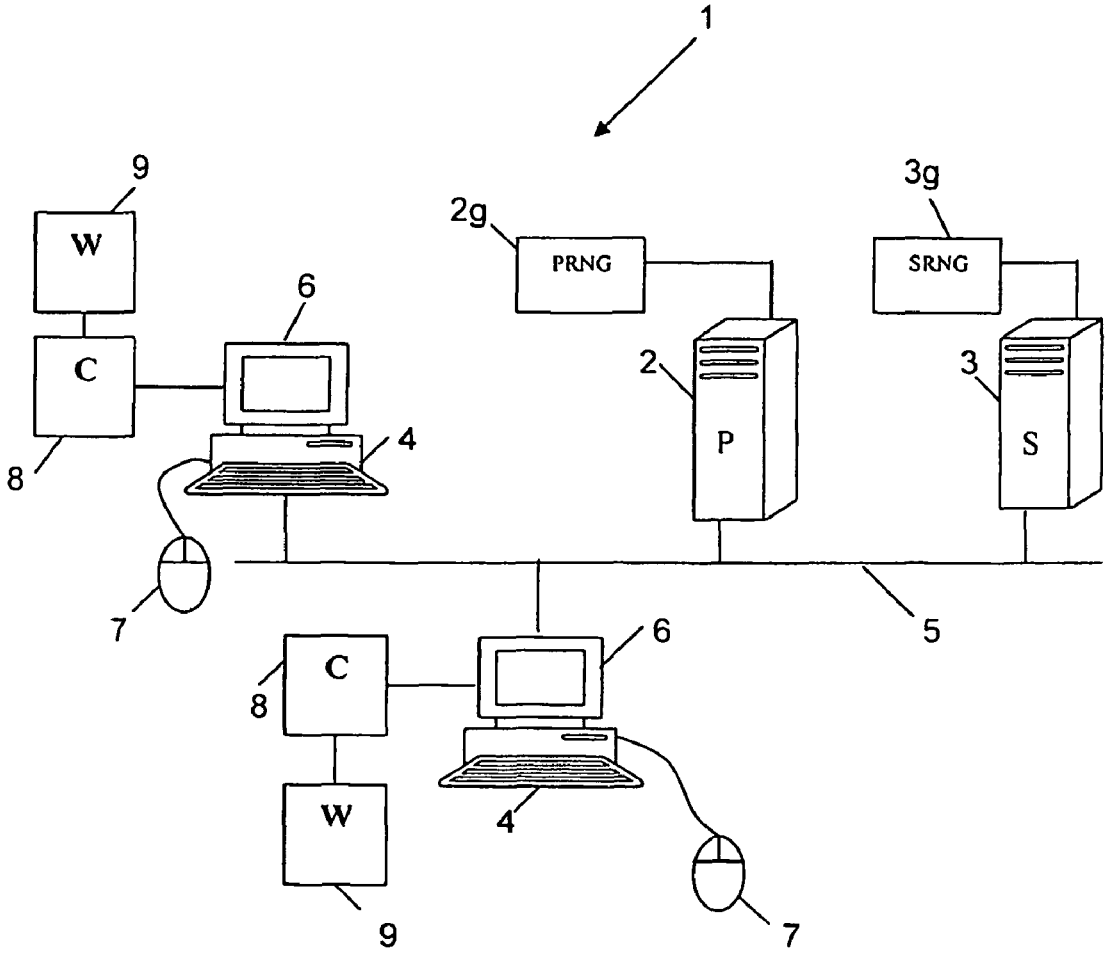
1
9
W
C
8
6
4
7
2g
PRNG
2
P
3g
SRNG
3
S
5
6
C
8
W
9
4
7

BACKUP RANDOM NUMBER GENERATOR GAMING SYSTEM

FIELD OF THE INVENTION

This invention relates to a gaming system and, more particularly, to a gaming system that enables a player to play a game of chance. The invention extends to a method of operation of the gaming system.

BACKGROUND TO THE INVENTION

Gaming systems for playing games of chance have become popular and increasingly common in a large number of different jurisdictions, for the purpose of providing entertainment and recreation to users thereof.

In its simplest form, a gaming system consists of a standalone player station, which offers a player a menu of one or more games of chance that the player can select for play. The games of chance have outcomes that are determined by random events, usually generated by means of a random number generator implemented in software. In an alternative topology, the gaming system may be a distributed one, in which one or more player stations are connected to a remote gaming server by means of a communication network. In the standalone implementation, the software random number generator executes locally within the player station itself, while in the distributed implementation, the software random number generator executes in the gaming server and serves each one of the remote player stations.

It will be appreciated by those skilled in the art that the software random number generator is a critical component of such a gaming system, as unreliability or failure of the random number generator renders the gaming system inoperative. This is particularly so in a distributed topology where multiple player stations rely on a single random number generator, as failure of the random number generator will have an impact on every one of the player stations. In order to minimise the possibility of failure of the random number generator, it is customary for the random number generator to be implemented on a high-reliability gaming server, which is unnecessarily expensive.

OBJECT OF THE INVENTION

It is an object of this invention to provide a gaming system, and a method of operation thereof, that will, at least partially, alleviate the abovementioned difficulties and disadvantages.

SUMMARY OF THE INVENTION

In accordance with this invention there is provided a gaming system, comprising: at least one player station capable of displaying to a player a simulation of at least one game of chance;

a primary random event generator communicable with the at least one player station by means of a communication network, the primary random event generator being responsive to a request from the at least one player station to generate one or more random events upon which an outcome of the at least one game of chance is based;

a secondary random event generator communicable with the at least one player station, the secondary random event generator being activatable by the at least one player station to generate, in response to a request from the at least one player station, one or more random events upon which an outcome of the at least one game of chance is based; and a controller arranged to monitor a status of the primary random event generator, the status of the primary random event generator being an active status when the primary random event generator generates one or more random events in response to a request from the at least one player station, and a failed status when the primary random event generator fails to generate one or more random events in response to a request from the at least one player station, the controller being arranged to automatically activate the secondary random event generator upon transition of the status of the primary random event generator from an active status to a failed status.

Further features of the invention provide for the secondary random event generator to be communicable with the at least one player station by means of the same communication network as the primary random event generator, for the secondary random event generator to have a status that is switchable between an inactive state when the status of the primary random event generator is active, and an active state when secondary random event generator is activated by the controller, for the primary and secondary random event generators to be software random number generators, for the primary software random number generator to be executable in a first gaming server remote from the at least one player station, for the secondary software random event generator to be executable in a secondary gaming server remote from the at least one player station, for the gaming system to include a watchdog facility that detects failure of either one of the primary random number generator and the primary gaming server, for the watchdog facility to transmit a request data packet to the primary gaming server at regular intervals and to monitor each request data packet for a corresponding response from the primary gaming server within a predetermined time interval, for the watchdog facility to instruct the controller to switch the status of the primary random event generator from the active state to the failed state when any request data packet from the watchdog facility does not receive a corresponding response from the primary random event generator within the predetermined time period, and for the at least one player station to direct any request for generation of the one or more random events to the secondary random event generator when the status of the primary random event generator is a failed status.

Still further features of the invention provide for the at least one player terminal to be a computer workstation, for the communication network to be the Internet, for the watchdog facility to be a watchdog timer program executable in the at least one player station, for the primary and secondary servers to be communicable with each other by means of the communication network, for the primary and secondary gaming servers to each have a corresponding storage memory, for the primary and secondary gaming servers to synchronize data in their respective storage memories at predetermined intervals, and for the secondary gaming server to generate any one or both of an audible and a visual alarm when failure of the primary gaming server has been detected by the watchdog facility.

The invention extends to a method of operation of a gaming system, comprising the steps of:

displaying to a player a simulation of at least one game of chance;

requesting a primary random event generator to generate one or more random events upon which an outcome of the at least one game of chance is based;

monitoring a status of the primary random event generator, the status of the primary random event generator being an active status when the primary random event generator generates one or more random events in response to a request, and a failed status when the primary random event generator fails to generate one or more random events in response to a request; and automatically activating a secondary random event generator, upon transition of the status of the primary random event generator from an active status to a failed status, to generate, in response to a request, one or more random events upon which an outcome of the at least one game of chance is based.

There is further provided for switching a status of the secondary random event generator between an inactive state when the status of the primary random event generator is active, and an active state when secondary random event generator has been automatically activated, for generating the one or more random events upon which an outcome of the at least one game of chance is based by means of primary and secondary software random number generators, for executing the primary software random number generator in a first gaming server, for executing the secondary software random event generator in a secondary gaming server, for detecting failure of either one of the primary random number generator and the primary gaming server by means of a watchdog facility, for transmitting request data packet from the watchdog facility to the primary gaming server at regular intervals and monitoring each request data packet for a corresponding response from the primary gaming server within a predetermined time interval, for switching the status of the primary random event generator from the active state to the failed state when any request data packet from the watchdog facility does not receive a corresponding response from the primary random event generator within the predetermined time period, and for directing any request for generation of the one or more random events to the secondary random event generator when the status of the primary random event generator is a failed status.

There is still further provided for associating the primary and secondary gaming servers with corresponding storage memories, for synchronizing data in the respective storage memories of the primary and secondary gaming servers at predetermined intervals, and for generating any one or both of an audible and a visual alarm when failure of the primary gaming server has been detected.

BRIEF DESCRIPTION OF THE DRAWINGS

A preferred embodiment of the invention is described below, by way of example only, and with reference to the abovementioned drawings, in which:

FIG. 1 is functional representation of a gaming system according to the invention.

DETAILED DESCRIPTION OF THE INVENTION

Referring to FIG. 1, a gaming system is indicated generally by reference numeral (1).

The gaming system (1) includes a primary gaming server (2), a secondary gaming server (3) and a plurality of player stations (4) located remotely from the gaming servers (2 and 3). Communication between the player stations (4) and the primary and secondary gaming servers (2 and 3) is provided by means of a communication network (5), that is in this embodiment, the Internet. Each player station (4) is composed of a computer workstation with a display monitor (6) and a pointing device (7) such as a mouse. Each computer workstation (4) operates under a Windows 2000 operating system, which is well known and commercially available from the Microsoft Corporation of Seattle, Wash., USA. The primary and secondary gaming servers (2 and 3) operate under the Windows NT system, which is also a product of the Microsoft Corporation.

The gaming system (1) enables a player to play a game of chance at any one of the player stations (4). A number of different players may play the game of chance simultaneously, each player playing from a different player station (4). It is anticipated that the player stations (4) will be placed at different locations throughout a geographic region, such as entertainment venues, shopping centres, games arcades, cinemas, night clubs, betting shops and the like.

The embodiments of the invention will be described with particular reference to a game of chance that is a single-player three-reel video slots game. It is to be clearly understood, however, that the invention extends to include the use of other types of single player games of chance such as, for example, video slots. Each gaming server (2 and 3) is instructable to execute a respective software random number generator (2*g* and 3*g*) that generates random events that determine the outcome of a turn of the three-reel video slots game. The computer workstation of each player terminal (4) executes a respective computer program that renders to the player on the display monitor (6) a simulation of the three-reel video slots game. The player controls the progress of the simulation of the three-reel video slots game by means of the pointing device (7). Each player station (4) also includes a controller (8) and a watchdog facility (9) that regulate interaction between the player station (4) and the primary and secondary gaming servers (2 and 3). The operation of the player stations (4) and the primary and secondary gaming servers (2 and 3) will be described in greater detail in the description that follows.

A player wishing to play a turn of the three-reel video slots game at a particular player station (4) is first required to place a wager on an outcome of the turn of the game. The player station (4) requests the generation of an outcome of the turn of the game from the gaming servers (2 and 3), according to the following steps:

1. the player station (4) stores a status of each of the primary and secondary gaming servers (2) and (3);
2. the status of the primary gaming server (2) is either an active status in which the primary gaming server (2) is able to generate one or more random events in response to the request from the player station (4), and a failed status when the primary gaming server (2) fails to generate one or more random events in response to a request from the player station (4);
3. the status of the secondary gaming server (3) is either an inactive status when the status of the primary gaming server (2) is active, or an active status when the status of the primary gaming sever (2) is a failed status;
4. if the status of the primary gaming server (2) is an active status, the controller (8) in the player station (4) routes the request from the player station (4) to the primary gaming server (2), whose corresponding random number generator (2*g*) generates a random event that determines the outcome of the turn of the three-reel video slots game, in particular, the outcome of a spin of the reels in the player's particular turn of the three-reel video slots game;
5. if the status of the primary gaming server (2) is a failed status, and the status of the secondary gaming server (3) is an active status, the controller (8) in the player station (4) routes the request from the player station to the secondary gaming server (3), whose corresponding random number generator (3*g*) generates a random event that determines the outcome of the turn of the three-reel video slots game, in particular, the outcome of a spin of the reels in the player's particular turn of the three-reel video slots game;

6. the primary gaming server (2) or the secondary gaming server (3), as requested, returns the outcome of the turn of the game to the player station (4), along the communication network (5), and the player station (4) displays the outcome of the turn of the game to the player on the display monitor (6) of the player station (4) in an intelligible manner, by simulating on the monitor (6) an animation of three spinning reels that come to rest at appropriate indexed positions corresponding to the generated outcome.

The status of the primary and secondary gaming servers (2 and 3) is monitored by the watchdog facility (9) in the player station (4). The watchdog facility (9) comprises a watchdog timer program (not shown) that is executed in the player station (4). The watchdog timer program (not shown) operates in a manner that is well known in the art, namely polling the primary gaming server (2) at regular intervals by transmitting to the primary gaming server (2) a request data packet at regular intervals and monitoring each request data packet for a corresponding response from the primary gaming server (2) within a predetermined time interval. Whenever an expected response is not received from the primary gaming server (2) within the predetermined time interval, the watchdog facility (9) switches the status of the primary gaming server (2) from active to failed, and the status of the secondary gaming server (3) from inactive to active. Upon occurrence of this event, future game outcomes are obtained from the secondary gaming server (3), as described above. The watchdog facility (9) also generates either one, or both, an audible alarm and a visible alarm when the status of the primary gaming server (2) changes from active to failed.

In order for the transition of the status of the primary gaming server (2) from active to failed, and the status of the secondary gaming server (3) from inactive to active, to occur seamlessly without interruption of service to the player at the player station (4), it is important that the primary and secondary gaming servers (2 and 3) be synchronized at regular intervals. Such synchronization occurs by means of the communication network (5) in a manner that is well known in the art and that will not, for this reason, be described here in detail.

Numerous modifications are possible to this embodiment without departing from the scope of the invention. In particular, the status of the primary and secondary gaming servers (2 and 3) may be stored centrally in each of the gaming servers themselves, where they are accessible to each of the player stations (4), rather than being stored locally in each of the player stations themselves. In the standalone topology described above, the primary and secondary software random number generators (2*g*,3*g*) may be executed on separate processors, respectively, within the player station (4) itself in order to provide a required degree of redundancy.

The invention therefore provides a gaming system (1) with redundant random number-generation that exhibits improved up time relative to prior art equivalents.

The invention claimed is:

1. A gaming system comprising:

at least one player station for displaying to a player a simulation of a game of chance;

a primary gaming server located remotely from the at least one player station and communicable with the at least one player station via a communication network, wherein the primary gaming server is configured to provide outcomes for the game of chance upon request from the at least one player station;

a secondary gaming server located remotely from the at least one player station and communicable with the at least one player station via the communication network, wherein the secondary gaming server is configured to provide outcomes for the game of chance upon request from the at least one player station;

a watchdog facility configured (i) to transmit a data packet to the primary gaming server at regular intervals and (ii) whenever an expected response is not received from the primary gaming server within a predetermined time interval, to change a status of the primary gaming server from active to failed; and a controller in the at least one player station for routing a request to provide an outcome of a turn of the game of chance, wherein the controller routes the request to the primary gaming server when the status of the primary gaming server is active and routes the request to the secondary gaming server when the status of the primary gaming server is failed.

2. A gaming system as claimed in claim 1, wherein the primary gaming server uses a primary random number generator to determine outcomes for the game of chance and the secondary gaming server uses a secondary random number generator to determine outcomes for the game of chance.

3. A gaming system as claimed in claim 2, wherein the primary and secondary random number generators are software random number generators.

4. A gaming system as claimed in claim 1, wherein the at least one player station is a computer workstation and the communication network is the Internet.

5. A gaming system as claimed in claim 1, wherein the watchdog facility is a program executed on the at least one player station.

6. A gaming system as claimed in claim 5, wherein the watchdog facility generates an alarm when the status of the primary gaming server changes from active to failed.

7. A gaming system as claimed in claim 6, wherein the is audible and/or visible.

8. A gaming system as claimed in claim 1, wherein the primary and secondary gaming servers synchronize their data at regular intervals.

9. A method of operating a gaming system, the gaming system comprising a player station, a primary gaming server, and a secondary gaming server, the player station being remotely located from and communicable with the primary and secondary gaming servers via a communication network, the method comprising the steps of:

displaying on the player station a simulation of a game of chance;

a watchdog facility transmitting a data packet to the primary gaming server at regular intervals;

the watchdog facility changing a status of the primary gaming server from active to failed whenever an expected response to the data packet is not received from the primary gaming server within a predetermined time interval;

a controller in the player station routing a request to provide an outcome of a turn of the game of chance, wherein the controller routes request to the primary gaming server when the status of the primary gaming server is active and routes the request to the secondary gaming server when the status of the primary gaming server is failed;

determining an outcome in response to the request; and the player station receiving the outcome via the communication network and displaying the outcome to a player.

10. A method as claimed in claim 9, wherein determining an outcome in response to the request comprises:

the primary gaming server executing a primary random number generator.

11. A method as claimed in claim 9, wherein determining an outcome in response to the request comprises:

the secondary gaming server executing a secondary random number generator.

12. A method as claimed in claim 9, further comprising:

executing the watchdog facility on the player station.

13. A method as claimed in claim 12, further comprising:

the watchdog facility generating an alarm when the status of the primary gaming server changes from active to failed.

14. A method as claimed in claim 13, wherein the alarm is audible and/or visible.

15. A method as claimed in claim 9, further comprising:

the primary and secondary gaming servers synchronizing their data at regular intervals.

* * * * *

UNITED STATES PATENT AND TRADEMARK OFFICE

CERTIFICATE OF CORRECTION

PATENT NO. : 8,251,790 B2
APPLICATION NO. : 10/576743
DATED : August 28, 2012
INVENTOR(S) : Moshal It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1198 days.

Signed and Sealed this
Twenty-third Day of April, 2013

Teresa Stanek Rea
*Acting Director of the United States Patent and Trademark Office*